United States Patent [19]

Carlson

[11] 4,016,775

[45] Apr. 12, 1977

[54] FINGER ACTUATED CONTROLLER

[75] Inventor: E. Frank Carlson, Maple Valley, Wash.

[73] Assignee: The United States of America as represented by the Secretary of the Navy, Washington, D.C.

[22] Filed: July 11, 1974

[21] Appl. No.: 487,697

[52] U.S. Cl. ..... 74/471 XY; 200/6 A; 74/543

[51] Int. Cl.[2] ..... G05G 9/00

[58] Field of Search ..... 74/523, 543, 471 R, 74/471 XY, 473 R; 244/83 R; 200/6 A, 157, 61.89

[56] References Cited

UNITED STATES PATENTS 2,762,234 9/1956 Dodd ..... 74/471 XY 2,791,664 5/1957 Rohacs ..... 200/157

*Primary Examiner*—Samuel Scott
*Assistant Examiner*—Frank H. McKenzie, Jr.
*Attorney, Agent, or Firm*—R. Sciascia; R. Beers; S. Sheinbein

[57] ABSTRACT

A finger actuated control device having a member movable in a plane about a neutral position whereby the distance moved from the neutral position is proportional to the value of the control adjustment of a system being controlled. The movable member is cantilevered away from the operator from an upper portion of a second moveable control device to which it is mounted and attached.

3 Claims, 4 Drawing Figures

LEVER 27 IS SPRING BIASED TO RETURN TO ITS CENTER POSITION

FINGER ACTUATED CONTROLLER

BACKGROUND OF THE INVENTION

The present invention relates to control devices, and more particularly to finger actuated control devices for controlling movement of mechanisms or systems.

The present invention is particularly suitable for control of a mechanism or system which may be controlled and operated by the selective manipulation of a control device. Such would be the case in governing the movements of control surfaces of a high performance aircraft, orientation of thrust rockets of a space station, or directional control of construction crane movements.

As various large scale human-controlled and operated systems evolve and acquire improved, added or enhanced capabilities, additional demands are often placed on the human controller. The operator must often perform additional control tasks with accuracy and speed while still performing all of his previous control tasks. Clearly it is important that any new control device not interfere with or degrade other operator control efforts.

Along with precision of control input afforded to the operator, it is often essential that he be readily informed as to the extent of control input he is providing. Also; in many control applications it is of great assistance to the human controller-operator to have the control device return to its neutral position upon removal of the operator's input.

Aircraft and aerospace are typical fields requiring extensive control by human operators with related need for operator control devices. Development of more sophisticated control systems have required development of increasingly sophisticated control systems. For example, a side-force control system to control translation movements of a high performance aircraft requires a control device for actuation by the pilot which will not interfere with operation of other aircraft controls. In addition the control must be operable by the pilot under physically stressful acceleration conditions (typically 1 g lateral acceleration in this application) so as not to be improperly moved.

The control device of the present invention satisfies these requirements while avoiding disadvantages inherent in prior art devices.

SUMMARY OF THE INVENTION

The present invention comprises a finger operated device having a member movable to the left or right about a neutral position. The member moves in response to the control force exerted by the operator's finger and returns to the neutral position when the finger pressure is relaxed.

An aspect of the control device of the present invention is that it is particularly well suited for use in conjunction with other control devices operated by the same hand that operates the device of the present invention.

BRIEF DESCRIPTION OF THE DRAWINGS

FIG. 1*a* shows the finger actuator in the neutral or centered position.

DETAILED DESCRIPTION OF THE INVENTION

For illustrative purposes, the finger actuated control device of the present invention will be described in an embodiment useful for application in control of high performance jet aircraft.

Figure 1A:
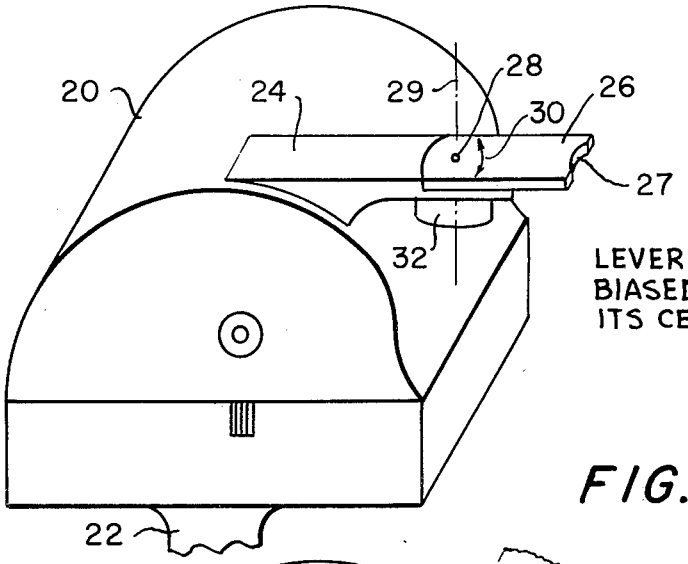
FIGS. 1*a*, *b*, and *c* are perspective views of the finger actuated control device as it would appear when mounted on a manually operable lever mechanism showing the finger actuated controller in an aircraft environment.
Figure 1B:
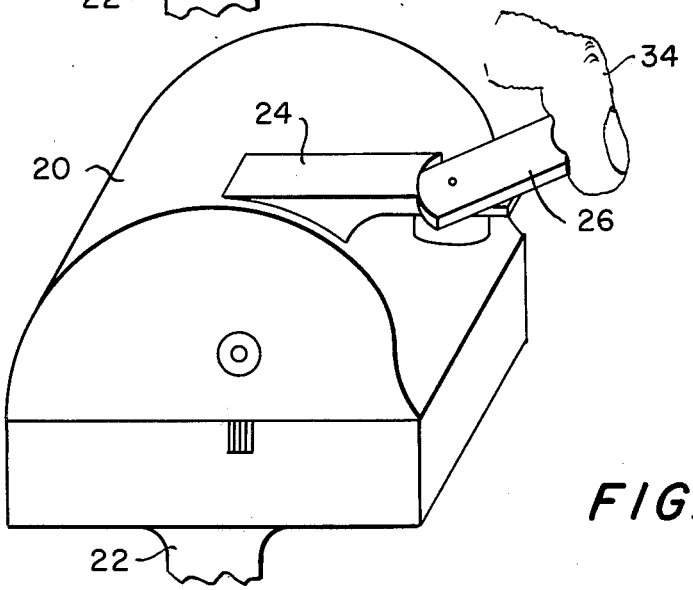
FIGS. 1*b* and 1*c* show a left and a right control displacement respectively.
Figure 1C:
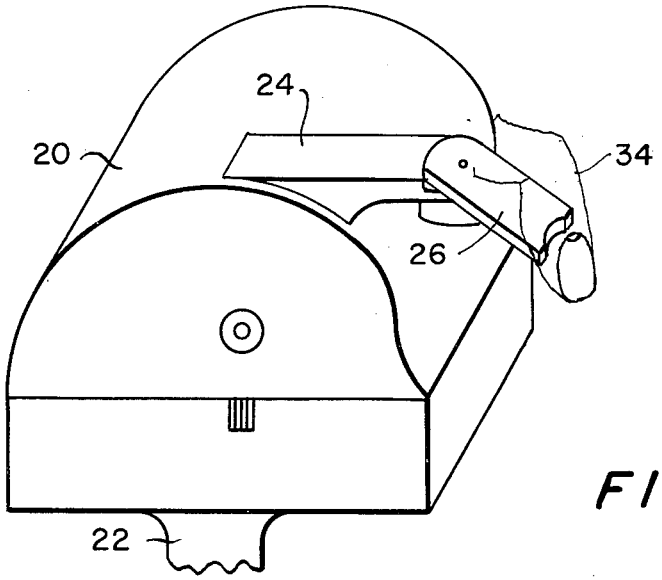
Figure 2:
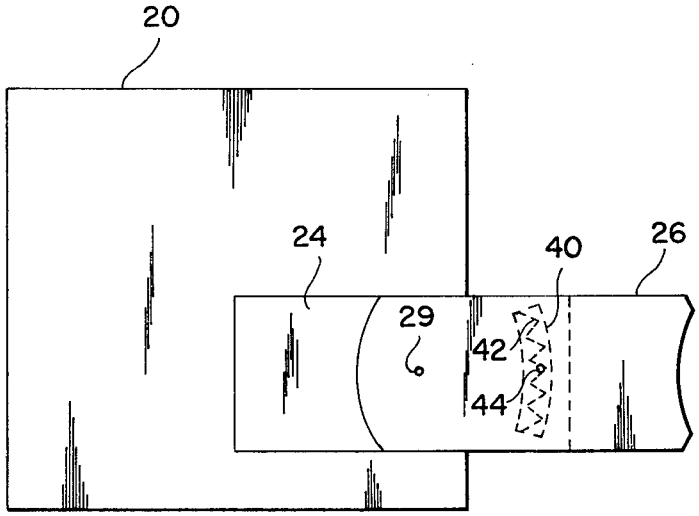
FIG. 2 is a top view of the control device showing the centering mechanism for the movable member.

The control device of this embodiment is illustrated pictorially in FIG. 1. A control lever such as a throttle control lever 22 has an upper portion 20 to which is attached a cantilevered support member 24. The end of support member 24 is fitted with a moveable generally rectangularly shaped member 26 which may pivot in the direction of arrows 30 about a pivot point 28 located on a pivot axis 29. The end 27 of the moveable member 26 is arcuately shaped so as to comfortably receive a finger 34 in order to rotate moveable member 26 about axis 29. A centering device such as spring biasing means returns moveable member 26 to its neutral position upon removal of activating pressure from finger 34. FIG. 2 shows a centering mechanism that can be used. A slot 40 is cut in the upper surface of the support member 24. A pair of springs 42 are positioned in the slot 40, and each is attached at one end of the slot to the support arm 44 and in the middle of the slot to a pin 24 which is affixed to the lower surface of the movable arm 26 and depends into the slot 40.

A position sensor such as a potentiometer 32 is mechanically coupled to moveable member 26, positioned with the center of its shaft coincident with the pivot axis 29 and is arranged to change the resistance presented at its output terminals in correspondence to the change in position of moveable member 26. The coupling may be made in any conventional manner such as a mechanical shaft, shown as dashed line 33, coupled between moveable member 26 and potentiometer 32 having a centerline lying on pivot axis 29 to transmit the rotational motion of member 26 to potentiometer 32. It should be noted that any other form of suitable position transducer may be employed in place of the potentiometer 32. Also, linear or non-linear control responses may be obtained by appropriate choice of the position transducer. For example, a logarithmic control response to a linear rotational input would be obtained if the potentiometer 32 were wound in a logarithmic fashion.

In operation of the present invention, the operator's hand is cupped over the uppermost portion 20 of the control lever such as throttle control lever 22. By pushing or pulling with this hand, the operator may move control lever 22 away or towards him, respectively. Also, the operator's hand is cupped so that one finger 34 of the operator's hand rests on the cantilevered member 24 and bends around to fit into the shaped end 27 of moveable member 26. By moving his finger to the left or right, the moveable member 26 is caused to move and thus actuate the control device. When the operator releases his finger pressure, the moveable member 26 is returned to its neutral position by the centering means above described.

By operation in this manner the operator is always aware of the state of his control input; the actuation force and the position of the moveable member 26 is indicative of the control input command which the control device is giving to the system being controlled.

Since the control device in this embodiment is mounted on the throttle lever 22, the aircraft central control "stick" is left intact. Interference with the central "stick" is minimized since no additional demands are placed on the hand that operates it. The control device of the present invention in this embodiment thus allows precise inputs to be made for a new heading by controlling an aircraft side force system with one hand while simultaneously and without interference making roll and pitch inputs to the "stick" with the other hand.

The present invention provides a control device activated by only one finger of an operator's hand moving to the left or right. The extent of movement corresponds to the magnitude of adjustment of the controlled system, and the position of the movable member is indicative of this magnitude. This actuation force and controller position is useful for providing the pilot continuously with information regarding the state of the control adjustment he is ordering.

Obviously, many modifications and variations of the present invention are possible in light of the above teachings. It is therefore to be understood that, within the scope of the appended claims, the invention may be practiced otherwise than as specifically described.

What is claimed is:

1. In an aircraft having a control lever controlling a throttle control, said control lever having a top portion knob-shaped for easy grasping by a pilot of the aircraft, the addition of a control device comprising:

a support arm having at least two sides and positioned along a longitudinal axis mounted at one end of said top portion and extending away therefrom;

a finger-operated elongated member pivotally mounted near one end thereof about a pivot point on said support arm and positioned along the same longitudinal axis as said support arm;

centering means connected to said finger-operated member for automatically returning it to said pivot point after said member has been moved about said pivot point to either side of said support arm, said finger-operated member having a free end which is arcuate-shaped to comfortably receive the finger of a pilot;

a position transducer located beneath said support arm;

linking means connecting said elongated member with said transducer, whereby movement of said finger of said elongated member about said pivot point provides a control input to said transducer proportional to said movement.

2. An aircraft control device in accordance with claim 1 wherein said finger-operated member is of reduced thickness compared to said support arm and movable in a horizontal plane.

3. An aircraft control device system as defined in claim 2, wherein said transducer is a potentiometer having a shaft center coincident with said pivot point on said support arm.

* * * * *